US006390335B1

(12) United States Patent
Lawson et al.

(10) Patent No.: US 6,390,335 B1
(45) **Date of Patent: *May 21, 2002**

(54) DEVICE WITH IMPROVED FITMENT SYSTEM

(75) Inventors: John Russell Lawson, Cincinnati, OH (US); Jelle Dankert Vuuk; Yvon Loic Crozet, both of Rome (IT)

(73) Assignee: The Procter & Gamble Company, Cincinnati, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/557,020

(22) Filed: Apr. 20, 2000

(30) Foreign Application Priority Data

Aug. 5, 1999 (EP) ..... 99870169

(51) Int. Cl.[7] ..... B67D 5/00

(52) U.S. Cl. ..... 222/153.13; 222/82; 222/83

(58) Field of Search ..... 222/81, 82, 83, 222/153.13, 153.14; 251/149.1, 149.6

(56) References Cited

U.S. PATENT DOCUMENTS 5,842,682 A * 12/1998 Schennum et al. ..... 251/149.1
6,095,370 A * 8/2000 Rhine et al. ..... 222/82

* cited by examiner

*Primary Examiner*—Philippe Derakshani
*Assistant Examiner*—Thach H. Bui
(74) *Attorney, Agent, or Firm*—Thibault Fayette; James C. Vago

(57) ABSTRACT

The present invention is directed to a device for the delivery of products, preferably cleaning products comprising an active ingredient, more preferably cleaning products comprising a surfactant. The device comprises at least one vented reservoir for containing at least one liquid product and a dispensing appliance for dispensing the product from the reservoir. In one embodiment, the reservoir comprises at least one recess and/or protrusion and the dispensing appliance comprises at least one corresponding protrusion and/or recess. The reservoir is releasably secured in a leak-tight manner with the dispensing appliance such that fluid communication between the reservoir and the dispensing appliance is established, only when the protrusion(s) and recess (es) are fitted into each other, and the protrusion(s) and the recess(es) of the reservoir have a shape which is complementary, preferably exactly complementary, to the protrusion(s) and/or recess(es) of the dispensing appliance.

22 Claims, 4 Drawing Sheets

DEVICE WITH IMPROVED FITMENT SYSTEM

FIELD OF THE INVENTION

The present invention relates to a device comprising a reservoir and a dispensing means, with improved fitment system between said reservoir and said means.

BACKGROUND OF THE INVENTION

Spray devices are known for the purposes of domestic cleaning, for example for cleaning hard surfaces such as windows, baths and ovens, as well as for spot cleaning of floor coverings such as carpets. Most spray devices which are commercially available are manually or electrically operated, that is to say that the devices comprise a pump which is activated or operated by the consumer. Most commonly this activation generates liquid pressure in a chamber displacement pump by means of a positive deplacement pump which in turn drives the liquid from the chamber usually through a dispensing nozzle. Many dispensing patterns are possible, but a conical spray is the most common. Usually, such spray devices comprise a reservoir filled with an active composition, and a means to dispense the composition from within said reservoir. The spray devices typically further comprise a basic fitment system to secure the reservoir onto the dispensing means, so as to establish a fluid communication between the two.

The following references are directed devices comprising a reservoir and a dispensing means which are fitted to each other prior to dispensing the contents of the reservoir through the means:

D1 (WO94/12825) is a PCT application to Mashburn. It discloses a reservoir/dispenser fitment wherein the reservoir's cap is fixed via bayonet means onto the dispenser. The cap is secured onto the dispenser once said cap has been rotated at least at a certain angle from the position of insertion (bayonet principle).

D2 (U.S. Pat. No. 5,435,462) is a US patent to Nordson Co. It discloses a reservoir/dispenser fitment wherein the reservoir's cap is fixed via screwing means onto the dispenser.

D3 (U.S. Pat. No. 4,699,188) is a US patent to Baker et Al. D4 (WO97/46479) is a PCT application to Anderson. They disclose liquid dispensing systems comprising a liquid dispenser, a reservoir closed with a cap. At the time the reservoir is fitted into the dispenser, a needle of the dispenser pierces through the cap to give access to the reservoir contents.

D5 (U.S. Pat. No. 03,966.093) is a US patent to Fraham et Al. D6 (WO93/07084) is a PCT application to the Cap Snap Cy. They both disclose fitment systems for water dispensers comprising a dispenser onto which an upside down reservoir is fitted. The fitment comprises sealing, venting, mounting, and filter elements.

D7 (U.S. Pat. No. 5,842,682) is a US patent to P&G. It discloses a non-leaking, non-venting liquid-filled canister quick-disconnect system. The system comprises a cap of a reservoir to fit into a recess of a liquid dispenser. The recess comprises a locking finger which mates a corresponding locking recess of the cap. In combination with the lock, the system comprises an umbrella valve which is part of the cap, and opens only upon insertion of the reservoir & cap into the liquid dispenser.

While solving some issues, the above mentioned inventions still present some disadvantages. Some of them were designed for heavy systems for use in industrial applications, but are not suitable for use with portable devices. Some do have a complex structure, and thus are expensive to manufacture, and may present some risks of leakage. Some others require a complex operation to fit the reservoir into the dispensing means.

More generally and in most systems for portable dispensing devices available in the art, perfect leak-tightness is not ensured. This is particularly true with portable devices since these are subject to movements in all directions during dispensing, even for devices wherein the fitment between the reservoir and the dispensing means consists in a hollow pin of the dispensing means pushed through a closing feature of the reservoir. In such cases, the reservoir would need to be accurately guided, and maintained inside the dispensing means, since any source of movement between the two will lead to deformation of the reservoir's cap and incorrect mating with the hollow pin of the dispensing means, and thus will be a source of leakage.

Such leakage is particularly undesirable in case the reservoir is filled with active compositions such as cleaning, bleaching, detergent compositions or the like, which can be irritant or dangerous to human safety, and must be kept away from children for example. Leakage is also clearly undesirable inside a dispensing means which comprises an electrical pumping means. More generally, it is the interest of the consumer to use a device which does not leak, and dispenses the product only onto predetermined area, and thus, prevents messy jobs.

Finally, and more importantly, some of the systems above, for instance the systems disclosed in D7, are not vented systems. This means that the fluid connection between the reservoir and the dispensing means allows fluid to exit said reservoir into said dispensing means, but it does not allow simultaneous admission of air back into the reservoir to compensate the loss of contents. Such non-vented systems are clearly undesirable, especially in case the reservoir's contents is pumped by an electrical pump in a continuous manner and/or is used over a long period without stopping the dispensing of liquid.

It is therefore one main object of the present invention to provide the user with a liquid dispensing device comprising a vented reservoir filled with a liquid, and a dispensing means, said reservoir and said means being fitted such as to prevent any leakage during the use of the device, and where the device is most preferably a portable device.

It is a further object of the present invention to provide a device wherein the reservoir is very easy to place/remove from the housing of the dispensing means.

It is another object of the present invention to provide a device wherein the fitment between the reservoir's opening and the dispensing means has a simple structure, and is cheap to produce.

SUMMARY OF THE INVENTION

The present invention is directed to a device for the delivery of products, preferably cleaning products comprising an active ingredient, more preferably cleaning products comprising a surfactant, the device comprising at least one vented reservoir for containing at least one liquid product and a means for dispensing the product from the reservoir, the device being characterized in that the reservoir comprises at least one recess and/or protrusion and the dispensing means comprises at least one corresponding protrusion and/or recess, said reservoir being releasably secured in a leak-tight manner with the dispensing means such that fluid communication between said reservoir and said means is established, only when said protrusion(s) and recess(es) are fitted into each other, and said protrusion(s) and said recess (es) of said reservoir have a shape which is complementary, preferably exactly complementary to said protrusion(s) and/or recess(es) of said dispensing means.

Preferably, the dispensing means comprises a push-button means for unlocking said reservoir from said dispensing means. Also preferably, the reservoir's neck is off-centered in the cross-sectional plan of said reservoir, and said reservoir fits into a complementary recess of the dispensing means, so that once locked in said dispensing means, lateral displacement of said reservoir is prevented. In a further preferred embodiment of the present invention, said at least one recess and/or protrusion of the reservoir is located at less than 25 cm, preferably less than 20 cm, more preferably less than 10 cm from the top of said reservoir.

BRIEF DESCRIPTION OF THE DRAWINGS

The invention will now be explained in detail with reference to the accompanying drawings, in which.

DETAILED DESCRIPTION OF THE INVENTION

The present invention is directed to a device (1) for dispensing a product onto a surface, preferably a cleaning a product, more preferably a cleaning product for treating carpets or other large fabric coverings. Said device (1) comprises the combination of a reservoir (10) for containing a composition, preferably a liquid cleaning product, with a means for dispensing the product. Said dispensing means (11) preferably comprises a housing, a spraying arm, and a means for conducting product from the reservoir (10) to the spraying arm.

Figure 5:
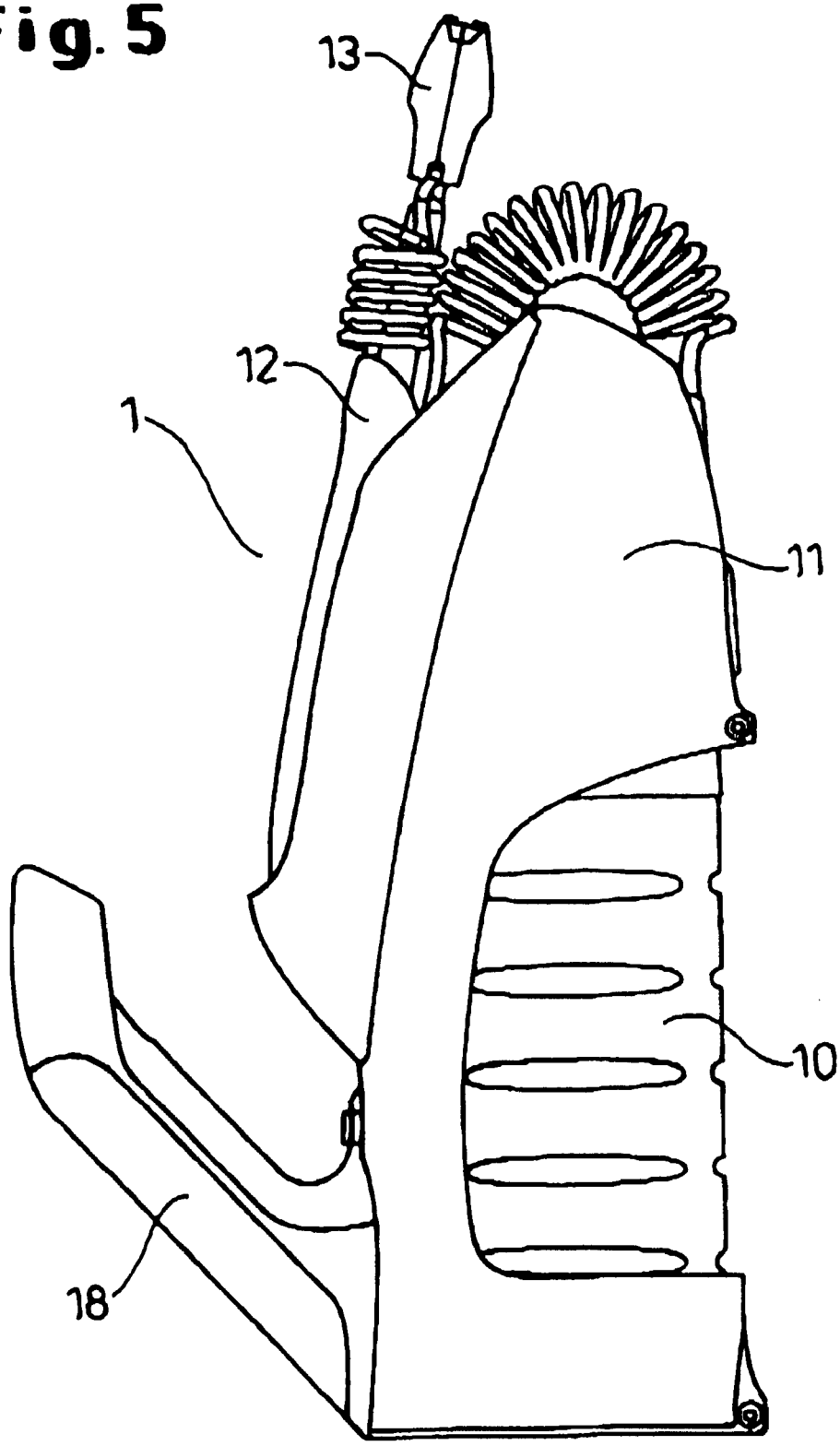
FIG. 5 is a global profile view showing a device according to the invention, comprising a dispensing means, and a reservoir locked thereinto.

It is a preferred feature of the device (1) of the present invention that the dispensing means (11) comprises a manually or electrically driven pump. More preferably, said dispensing means (11) comprises an electrically driven pump which is used to pump product from the reservoir (10) through the spraying arm and out of the product dispensing opening (or openings) located in the spraying arm, to the surface to be treated. In this way, the dispensing means (11) connected to a reservoir (10) constitutes an electrical spraying device (1), as shown for example in FIG. 5. The product dispensing openings are preferably nozzles which are selected so that the sprayed product takes the form of a continuous stream or film, or of a discontinuous stream or film of fine particles, or of a mist, or of a foam. It is most preferred that the spray pattern is in the form of fine particles because this is the most efficient way to cover a large surface area with a small volume of product with an even coverage. Typically the product output is from about 20 ml/minute to about 400 ml/minute, and preferably from about 150 ml/minute to about 250 ml/minute, the product being typically suitable for carpet cleaning. The device (1) of the present invention is to be used for example for spraying household cleaning or laundry products, or perfumes. In a preferred embodiment, the device (1) is a cleaning solution used for the cleaning of surfaces such as fabrics, carpets, floors, and ceilings.

It is preferred that the spray arm (12) has one nozzle (13), but it may also have multiple nozzles located along its length. The spray arm (12) makes it easier to control where the cleaning product is sprayed. For example, when cleaning carpets the spray arm (12) makes it easier to avoid spraying product onto furniture and walls, and also enables access into corners which would otherwise be difficult to reach. Furthermore, an ergonomically designed spray arm (12) avoids the need for the user to have a bent back when spraying. The spray arm (12) is preferably extendible and/or detachable from the dispensing means housing.

The Dispensing Means

The dispensing means (11) comprises a means for conducting the product from the reservoir (10) through the spray arm (12), to the product dispensing opening from which said product is dispensed. Said means for conducting the product is connected to the reservoir (10) and to the spray arm (12), for example via pipes, which can be for example flexible plastic pipes. The means for conducting the product from the reservoir (10) to the spray arm (12) is preferably contained into the housing, as well as the pipes, if any.

In a particularly preferred embodiment of the present invention, the means for conducting the product from the reservoir (10) through the spray arm (12) to the product dispensing opening comprises an electrically driven pump. The electrically driven pump may be, for example, a gear pump, an impeller pump, a piston pump, a screw pump, a peristaltic pump, a diaphragm pump, or any other miniature pump. In the preferred embodiment the pump is a gear pump with a typical speed between 6000 and 12000 rpm.

Figure 1:
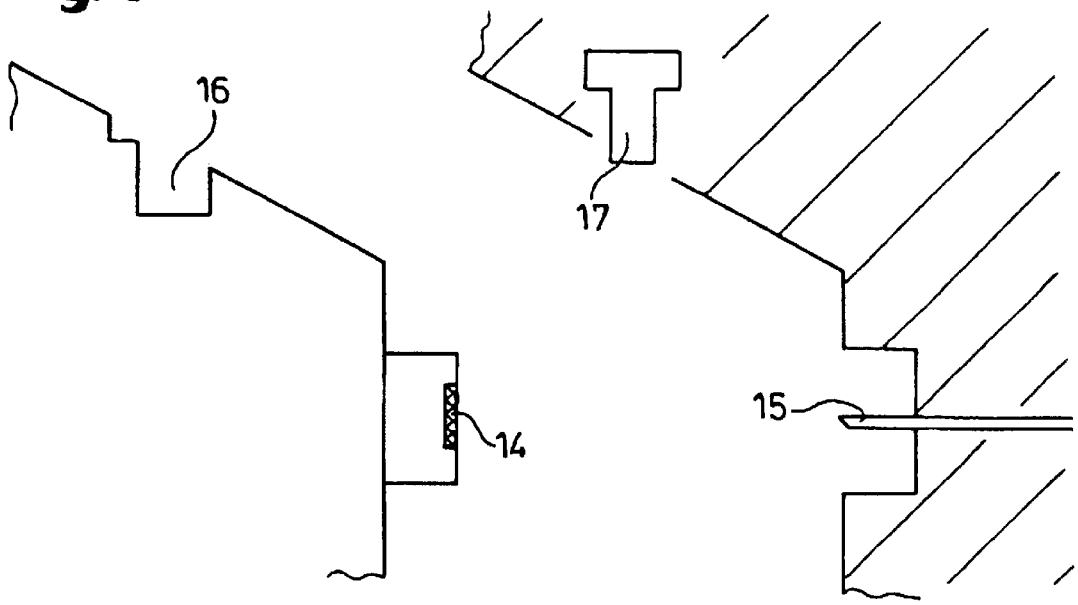
FIG. 1 is a profile cut view showing a protrusion on the interior of the dispensing means, and a recess in the body of the reservoir, said reservoir being unlocked from the dispensing means.
Figure 2:
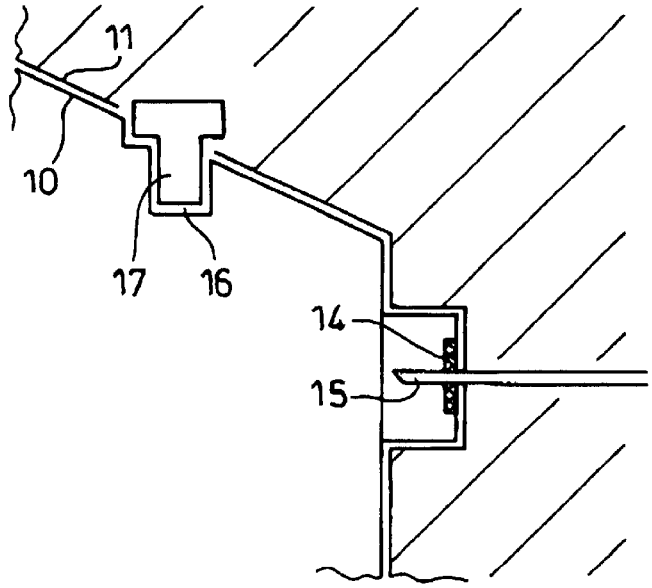
FIG. 2 is a profile cut view showing a protrusion on the interior of the dispensing means, and a recess in the body of the reservoir, said reservoir being locked into the dispensing means so as to establish a fluid communication between the two through the needle, in a leak-tight manner.
Figure 3:
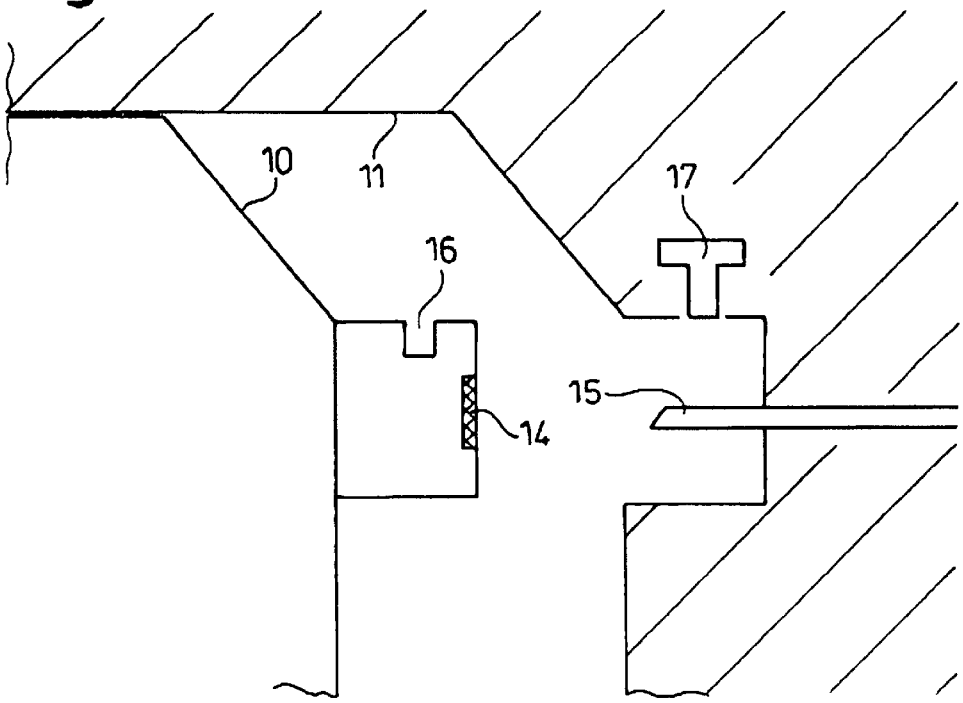
FIG. 3 is a profile cut view showing a protrusion on the interior of the dispensing means, near the needle, and a recess in the reservoir, near the neck (or in the cap), said reservoir being unlocked from the dispensing means.
Figure 4:
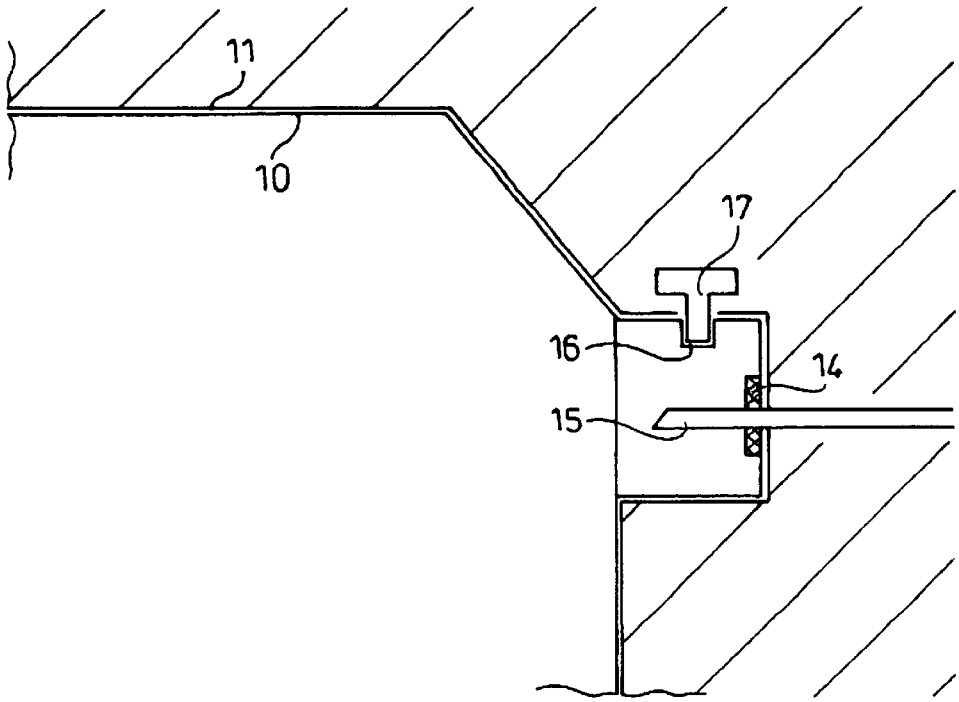
FIG. 4 is a profile cut view showing a protrusion on the interior of the dispensing means, near the needle, and a recess in the reservoir, near the neck (or in the cap) said reservoir being locked into the dispensing means so as to establish a fluid communication between the two through the needle, in a leak-tight manner.

The dispensing means (11) comprises a means, for example at least one needle (15), which fits with the neck (19) and/or with the cap of the reservoir (10), as shown in FIGS. 1 to 4. More preferably, the reservoir (10) is hermetically closed by a cap comprising a rubber septum (14) and the appliance comprises two needles, one being connected to the pumping means, the other one comprising a one-way valve for letting air enter the reservoir (10) while the contents is removed therefrom, thus playing the role of a venting system. At first use, when the consumer inserts the reservoir (10) into the dispensing means (11), the rubber septum (14) is pierced, as shown in FIGS. 2 and 4, so as to establish a leak-tight fluid communication between the interior of said reservoir (10) and the dispensing means (11). Then, the reservoir's contents is pumped through one needle (15), to the pump, up to the spray arm's nozzles, and is dispensed to the surface to treat. This provides a device wherein the operation of plugging/unplugging the reservoir from the housing of the dispensing means in order to establish a fluid, but leak-tight, communication between the two is very easy and obvious to the consumer. It also provides a fitment which is not very complex (needle and rubber septum) and thus quite cheap to produce.

The electrically driven pump must be driven by a means such as an electric motor. The electric motor typically produces a torque between 1 and 20 mN.m. The electric motor must, in turn be provided with a power source. The power source may be either mains electricity (optionally via transformer), or it may be a throw-away battery, or rechargeable battery. Most preferred are one or more AA rechargeable or disposable batteries, the batteries being housed in the package. The voltage output of the battery is typically between 1.5 and 12 Volts, with a preferred output between 3 and 6V.

In one embodiment of this invention, the pump is designed to be reversible, so that it can dispense liquid from the reservoir (10), and suck liquid from a surface, or only from the pipes of the dispensing means (11), back into the same or preferably another reservoir (10). Typically, only small amounts of liquid can be sucked back from a surface, and such a reversible pump is not intended to replace the use of a vacuum cleaner. Several ways of inverting the rotation of the pump can be used. In one example, the pump and motor are linked to a timer and an electronic circuit, such that after a defined time (eg. 15 seconds) the motor is not used, it automatically starts again, and its rotation side is reversed. As a result, the remaining product in the tubing and the extension of the dispensing means (11) is sucked back into the reservoir (10). As a consequence when replacing a product by another one, it is easy to change the product without mixing new and old products. For example, the consumer can use the dispensing means (11) for dispensing a first type of composition, then wait for the pump to suck back said first composition from the pipes, and then change the reservoir (10) or its contents to dispense a second composition without mixing of the two compositions inside the pipes.

It is an essential feature of the device (1) according to the present invention that the dispensing means (11) comprises at least one recess and/or protrusion (17) to fit onto at least one corresponding protrusion and/or recess (16) of the reservoir, said reservoir (10) being releasably secured in a leak-tight manner into the dispensing means (11) such that fluid communication between said reservoir (10) and said means is established, only when said protrusion(s) and recess(es) are fitted into each other, and said protrusion(s) and said recess(es) (16) of said reservoir (10) have complementary shapes of said protrusion(s) and/or recess(es) (17) of said dispensing means (11). Preferably, the dispensing means comprises at least one protrusion that fits into a corresponding and complementary recess of the reservoir, as shown in FIGS. 1 to 4. Also preferably, said protrusion(s) and said recess(es) (16) of said reservoir (10) have exactly complementary shapes of said protrusion(s) and/or recess (es) (17) of said dispensing means (11). Indeed, it is preferred that all the contours of the reservoir fit all the contours of the recess of the dispensing means, thus providing enhanced maintain of said reservoir. However, the shape of the reservoir may be such that it differs from the shape of the dispensing means' housing but still fits therein, such that a fluid connection between the two is established. However, it will be easily understood that the risk of leakage is enhanced in case all the contours of the reservoir are not properly maintained by the contours of the dispensing means.

The Handling Means

The device (1) according to the present invention is preferably hand-held, and therefore preferably comprises a holding means, which is more preferably integrated to the housing of the dispensing means (11). The holding means may be any sort of handle (18) which will allow the user to pick up the device (1) and to carry it to the place where the spraying is to be carried out. The handle (18) can be part of the reservoir (10) or of the housing of the dispensing means (11). It is likely that the device (1) will be carried around a whole room when a carpet is being cleaned, and/or will be manipulated in all directions during use. The handle (18) may be a simple protrusion or indentation which may be gripped by the user, or it may be a more sophisticated design for ergonomic reasons.

In one alternative embodiment of the present invention, the housing of the dispensing means (11) comprises a means allowing the user to carry it without using hands. In a first example, the housing comprises a clip which allows the user to hang said housing to a belt. In another example, the housing comprises at least one shoulder strap which allows to carry said housing on the shoulder/back. Other such means may be applied which allow the user to use both hands for other tasks.

The Reservoir

The device (1) comprises at least one reservoir (10) which can be of any type capable of containing a product under liquid form—by liquid it is meant to include embodiments when the product comprises a solid and a solvent for progressively dissolving said solid. Also included are liquids comprising small particles in suspension. Said reservoir (10) is preferably located into the housing of the dispensing means (11), and can be made out of any suitable material, such as metal, alloy, glass, but is preferably made out of plastic. It comprises at least one compartment comprising at least one composition. It is a further essential feature of the device according to the present invention, that the reservoir be vented. This means that the reservoir (10) comprises a means for connection to the dispensing means (11), such that it provides fluid connection between the two and allows fluid to exit said reservoir into said dispensing means (11), but it also allows simultaneous admission of air back into the reservoir (10) to compensate the loss of contents. Such a vented reservoir is clearly necessary, especially in case the reservoir's contents is pumped by an electrical pump in a continuous manner and/or is used over a long period without stopping the dispensing of contained product. Indeed, while the contents is being removed from the reservoir, the same volume of gas or air needs to be replaced, otherwise, a depression is created which stops the pump after a while. Some alternative solutions could be envisaged, such as for example a reservoir made of two portions, one rigid outer shell combined with a flexible collapsible inner pouch. In such a system, the inner pouch would progressively collapse during dispensing of the product, thus avoiding the need for replacement of the dispensed contents by a gas, and thus avoiding the need for a venting system. However, it has been found that such alternative systems are technically difficult to manufacture, and are expensive.

In a preferred embodiment of the invention, the dispensing means comprises two needles: one is for dispensing of liquid from the reservoir, the other one is for admission of air back into said reservoir, so as to ensure that the loss of contents in said reservoir is compensated. Such a connection system ensures that the reservoir is correctly vented, thus ensuring proper continuous pumping and dispensing of its contents.

The at least one reservoir (10) can be fixed into the housing of the dispensing means (11), and then, preferably comprises one opening, more preferably a reclosable opening. Alternatively, the at least one reservoir (10) can be removable from the housing of the dispensing means (11), so that it is replaceable when empty, or it can be refilled, for example with tap water.

In a first embodiment, the dispensing means (11) comprises one reservoir (10) with one compartment, comprising one or more composition(s), preferably one composition.

In a second embodiment, the dispensing means (11) comprises one reservoir (10) with at least two different compartments, each of which can comprise different compositions, for example non-miscible compositions or two chemically reacting solutions which react once mixed. Such a reservoir (10) is made for example by an extrusion blowing process.

In a third embodiment, the dispensing means (11) comprises at least two separate reservoirs. These reservoirs can have different shapes, for example they can be designed with complementary shapes. Alternatively, different reservoirs can be plugged into the dispensing means (11) at different locations. Said reservoirs can comprise one or more compartments comprising same, but most preferably different products.

In a forth embodiment, the dispensing means (11) comprises at least one portion for connecting a reservoir (10) comprising a liquid such as a solvent or water, and at least one additional portion for connecting a small cartridge of a concentrated composition, for example under liquid, gel or granulated form. At the time the consumer uses the dispensing means (11), the composition contained into the cartridge will be dissolved into the solvent or water, and the resultant active liquid composition will be dispensed through the spray nozzle (13). Alternatively, said cartridge is connected directly into one portion of a reservoir (10). The cartridge can be for example screwed into an appropriate opening of the housing, or of the reservoir (10). It comprises a seal portion, such that when fully screwed, it sealably closes said appropriate opening.

In all of the preceding embodiments, when the dispensing means (11) comprises more than one reservoir (10), the proportion of product pumped can differ from one reservoir (10) to another. For example, this is achieved by selecting pipes of different diameters for a reservoir (10) and another, or by adding a flow-control means to the pipes between one reservoir (10) and the pump.

In another embodiment, the present invention is a kit comprising the dispensing means (11) and at least one reservoir (10) comprising a product. Preferably, the kit comprises the dispensing means (11) and a set of several removable reservoirs, each comprising a different product. The different products can be products for treating different areas such as carpets, kitchen surfaces, bathroom surfaces, cars or else.

Figure 6:
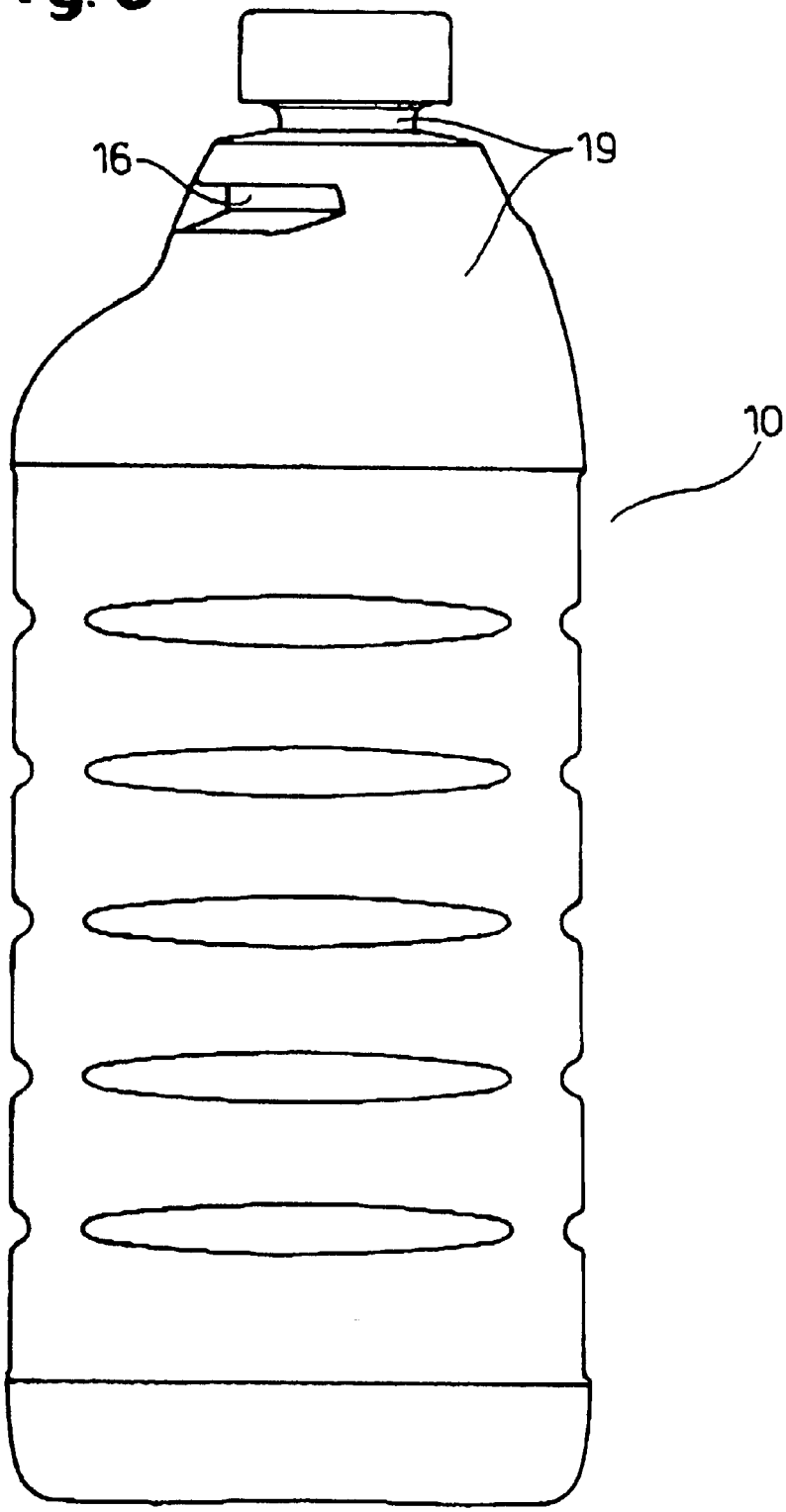
FIG. 6 is a side view of the reservoir, showing the off-centered neck.

In a particularly preferred embodiment of the present invention, the neck (19) of the reservoir (10) is off-centered in the cross sectional plan of the said reservoir (10), relatively to the central axis of said reservoir (10), and the reservoir (10) is non-cylindrical. This is best shown in FIG. 6. Such a shape prevents the reservoir (10) from moving laterally and/or rotationally into the dispensing means housing, especially during use, thus preventing leakage.

The reservoir (10) comprises at least one recess and/or protrusion (16) to fit into at least one corresponding protrusion and/or recess (17) of the device's dispensing means (11), said reservoir (10) being releasably secured in a leak-tight manner into the dispensing means (11) such that fluid communication between said reservoir (10) and said means is established, only when said protrusion(s) and recess(es) are fitted into each other, and said protrusion(s) and said recess(es) (16) of said reservoir (10) have complementary shapes of said protrusion(s) and/or recess(es) (17) of said dispensing means (111). Preferably, the reservoir (10) comprises at least one recess (16) that fits to a corresponding and complementary protrusion (17) of the dispensing means (11), as shown in FIGS. 1 to 4. Also preferably, said protrusion(s) and said recess(es) (16) of said reservoir (10) have exactly complementary shapes of said protrusion(s) and/or recess(es) (17) of said dispensing means (11), for the reasons explained above.

Reservoir/Dispensing Means Fitment

It has been shown that devices that comprise the assembling of a main unit and a reservoir (10), and which are subject of movements in all directions during use, are subject to leakage between said reservoir (10) and said dispensing means (11). This leads to spilling of product onto unexpected areas, which is clearly messy, and can even be dangerous, depending on the nature of the product which is dispensed.

It has further been found that providing a reservoir (10) which non-cylindrical, and has a off-centered neck (19) provides stability and prevents lateral and rotational movements of said reservoir (10) within the dispensing means's housing. However, there can still be some leakage due to axial movement of the reservoir (10) (i.e. along the longitudinal axis of the reservoir). In order to prevent such axial movements, the device (1) according to this invention is provided with a releasable locking fitment between the reservoir (10) and the housing. Thus, it is an essential feature of the present invention that the reservoir (10) comprises at least one recess and/or protrusion and the dispensing means (11) comprises at least one corresponding protrusion and/or recess, said reservoir (10) being releasably secured in a leak-tight manner with the dispensing means (11) such that fluid communication between said reservoir (10) and said means is established, only when said protrusion(s) and recess(es) are fitted into each other, and said protrusion(s) and said recess(es) of said reservoir (10) have a shape which is complementary to said protrusion(s) and/or recess(es) of said dispensing means (11). Preferably, said protrusion(s) and said recess(es) (16) of said reservoir (10) have exactly complementary shapes of said protrusion(s) and/or recess (es) (17) of said dispensing means (11), for the reasons explained above.

In a first embodiment, and as shown in FIGS. 1 and 2, the reservoir (10) comprises one recess which is located in one of its lateral walls, i.e. in its body portion. The dispensing means (11) comprises one protrusion which is positioned such that when the needle (15) of said dispensing means (11) has pierced the rubber septum (14) of the reservoir's cap, and a fluid communication is established between the two, the protrusion exactly fits into the recess. In this way, the reservoir (10) is tightly maintained into the housing, thus preventing leakage of product at the interface between the needle (15) and the septum (14).

In a second embodiment of the present invention, as shown in FIGS. 3 and 4, the reservoir (10) comprises one recess which is located near the top, for example on the neck (19), or even directly on the cap. The dispensing means (11) comprises one protrusion which is positioned such that when the needle (15) of said dispensing means (11) has pierced the rubber septum (14) of the reservoir's cap, and a fluid communication is established between the two, the protrusion exactly fits into the recess. This second embodiment might be preferred to the first one. Indeed, the bottle is preferably manufactured with a blow-molding process. Thus, tolerances in the bottle are not as precise as the tolerance of a piece which is injection molded. There is a need for high accuracy in the mating of the fitment system to prevent movement of the reservoir (10) within the dispensing means housing. This is highly critical in the region of the connection between the needle (15) and the rubber septum (14), where the risk of leakage is the highest. It was found that by minimizing the distance between the fitment and the septum (14)/needle (15) connection, the reservoir (10) is better held in place into the housing, in the region of the septum (14)/needle (15) connection.

In any case, it is a preferred feature of the device (1) according to the present invention, that the at least one recess and/or protrusion of the reservoir (10) is located at less than 25 cm, preferably less than 20 cm, more preferably less than 10 cm from the top of said reservoir (10).

It is essential that the fitment between the reservoir (10) and the dispensing means (11) be releasable. To this effect, the at least one protrusion is movable, such that it can be engaged/disengaged from the corresponding recess(es). This is preferably achieved by providing a fitment which is of the push-button type, press-button type, or any other suitable means for releasing the at least one protrusion from the at least one recess. More preferably, the fitment is a push-button releasable fitment. It comprises a movable protrusion which is mounted with a spring means, for example an helicoidal metallic spring, or a plastic spring blade. The protrusion is connected to a push button, which is accessible to the consumer from the outside of the device's housing. When the reservoir (10) is in place and locked into the housing, the user can exert a push on the button, to release the protrusion from the reservoir's recess, and remove said reservoir (10) from the device (1).

The protrusion can have any shape, as long as it is an exact complementary shape of the recess. For example, in can be a simple pin, but it can also be a hook, or it can even have more complex shape, as door keys have.

What is claimed is:

1. A device for the delivery of products, comprising:

a vented reservoir for containing a liquid product and a means for dispensing the product from said reservoir; wherein said reservoir comprises at least one of a recess or protrusion and said dispensing means comprises at least one of a corresponding protrusion or recess, said reservoir being releasably secured in a leak-tight manner with the dispensing means such that fluid communication between said reservoir and said means is established, when said at least one of said recess or protrusion of said reservoir engages said at least one of said corresponding recess or said corresponding protrusion of said dispensing means and wherein said reservoir has a neck which is off-centered in the cross-sectional plan of said reservoir.

2. The dispensing device according to claim 1, wherein said dispensing means comprises a push-button for unlocking said reservoir from said dispensing means.

3. The dispensing device according to claim 1, wherein said at least one of said recess or said protrusion of said dispensing means has a shape which is complimentary to said at least one of said corresponding recess or said corresponding protrusion of said dispensing means so that lateral displacement of said reservoir is prevented.

4. The dispensing device according to claim 1, further comprising an electrically driven pump which is provided with an electrical power source having at least one electrical battery.

5. The device according to claim 1, wherein said at least one of said recess or said protrusion of said reservoir is located less than about 25 cm from the top of said reservoir.

6. The device according to claim 1, wherein said at least one of said recess or said protrusion of said reservoir is located onto a neck or a closure of said reservoir.

7. The dispensing device according to claim 1, wherein said dispensing means comprises two needles which pierce a rubber septum of said reservoir, wherein one of said needles directs liquid from said reservoir and the other of said needles vents said reservoir.

8. A device for the delivery of products, comprising:

a vented reservoir for containing a liquid product and a means for dispensing the product from said reservoir; wherein said reservoir comprises at least one of a recess or protrusion and said dispensing means comprises at least one of a corresponding protrusion or recess, said reservoir being releasably secured in a leak-tight manner with the dispensing means such that fluid communication between said reservoir and said means is established, when said at least one of said recess or protrusion of said reservoir engages said at least one of said corresponding recess or said corresponding protrusion of said dispensing means; and an electrically driven pump which is provided with an electrical power source having at least one electrical battery.

9. The dispensing device according to claim 8, wherein said dispensing means comprises a push-button for unlocking said reservoir from said dispensing means.

10. The dispensing device according to claim 8, wherein said at least one of said recess or said protrusion of said dispensing means has a shape which is complimentary to said at least one of said corresponding recess or said corresponding protrusion of said dispensing means so that lateral displacement of said reservoir is prevented.

11. The dispensing device according to claim 8, wherein said at least one recess or said protrusion of said reservoir is located less than about 25 cm from the top of said reservoir.

12. The dispensing device according to claim 8, wherein said at least one of said recess or said protrusion of said reservoir is located onto the neck or closure of said reservoir .

13. The dispensing device according to claim 8, wherein said dispensing means comprises two needles which pierce a rubber septum of said reservoir, wherein one of said needle directs liquid from said reservoir and the other of said needles vents said reservoir.

14. A device for the delivery of products, comprising:

a vented reservoir for containing a liquid product and a means for dispensing the product from said reservoir; wherein said reservoir comprises at least one of a recess or protrusion and said dispensing means comprises at least one of a corresponding protrusion or recess, said reservoir being releasably secured in a leak-tight manner with the dispensing means such that fluid communication between said reservoir and said means is established, when said at least one of said recess or protrusion of said reservoir engages said at least one of said corresponding recess or said corresponding protrusion of said dispensing means and wherein said at least one recess or said protrusion of said reservoir is located less than about 25 cm from the top of said reservoir.

15. The dispensing device according to claim 14, wherein said dispensing means comprises a push-button for unlocking said reservoir from said dispensing means.

16. The dispensing device according to claim 14, wherein said at least one of said recess or said protrusion of said dispensing means has a shape which is complimentary to said at least one of said corresponding recess or said corresponding protrusion of said dispensing means so that lateral displacement of said reservoir is prevented.

17. The dispensing device according to claim 14, wherein said at least one of said recess or said protrusion of said reservoir is located onto the neck or closure of said reservoir.

18. The dispensing device according to claim 14, wherein said dispensing means comprises two needles which pierce a rubber septum of said reservoir, wherein one of said needle directs liquid from said reservoir and the other of said needles vents said reservoir.

19. A device for the delivery of products, comprising:

a vented reservoir for containing liquid product and a means for dispensing the product from said reservoir; wherein said reservoir comprises at least one of a recess or protrusion and said dispensing means comprises at least one of a corresponding protrusion or recess, said reservoir being releasably secured in a leak-tight manner with the dispensing means such that fluid communication between said reservoir and said means is established, when said at least one of said recess or protrusion of said reservoir engages said at least one of said corresponding recess or said corresponding protrusion of said dispensing means and wherein said dispensing means comprises two needles which pierce a rubber septum of said reservoir, wherein one of said needle directs liquid from said reservoir and the other of said needles vents said reservoir.

20. The dispensing device according to claim 19, wherein said dispensing means comprises a push-button for unlocking said reservoir from said dispensing means.

21. The dispensing device according to claim 19, wherein said at least one of said recess or said protrusion of said dispensing means has a shape which is complimentary to said at least one of said corresponding recess or said corresponding protrusion of said dispensing means so that lateral displacement of said reservoir is prevented.

22. The dispensing device according to claim 19, wherein said at least one of said recess or said protrusion of said reservoir is located onto the neck or closure of said reservoir.

* * * * *

UNITED STATES PATENT AND TRADEMARK OFFICE

CERTIFICATE OF CORRECTION

PATENT NO. : 6,390,335 B1 
DATED : May 21, 2002
INVENTOR(S) : John Russell Lawson, Jelle Danker Vuijk and Vyon Loic Crozet It is certified that error appears in the above-identified patent and that said Letters Patent is hereby corrected as shown below:

Title page,
Item [75], Inventor name is misplaced. Please change from "Jelle Danker Vuuk" to -- Jelle Danker Vuijk --
Item [56], References Cited, are incorrect,

| | | | | |
|---|---|---|---|---|
| "5,842,682 | * | 12/1998 | Schennum et al. | 251/149.1 |
| 6,095,370 | * | 8/2000 | Rhine et al. | 222/82" |

Please add:

| | | | | |
|---|---|---|---|---|
| -- 3,966,093 | * | 6/1976 | Frahm et al. | |
| 4,154,375 | * | 5/1979 | Bippus | |
| 4,699,188 | * | 10/1987 | Baker et al. | |
| 5,299,608 | * | 4/1994 | Bosyj | |
| 5,435,462 | * | 7/1995 | Fujii | |
| 5,716,07 | * | 2/1998 | Nottingham et al. | |
| 5,842,682 A | * | 12/1998 | Schennum et al. | 251/149.1 |
| 6,095,370 | * | 8/2000 | Rhine et al. | 222/82 |
| WO 94/12825 | * | 6/1994 | Country — PCT) -- | |

Signed and Sealed this

Eighth Day of October, 2002

*Attest:*

*Attesting Officer*

JAMES E. ROGAN
*Director of the United States Patent and Trademark Office*